United States Patent [19]

Carmichael et al.

[11] Patent Number: 4,752,236

[45] Date of Patent: Jun. 21, 1988

[54] SECURITY LATCH FOR ELECTRICAL CONNECTORS

[76] Inventors: Guy M. Carmichael, 651 Pennsylvania, #1, Beaumont, Calif. 92223; Ronald U. Hans, 34907 Cedar Ave.; Helmut Hans, 36435 Jomar St., both of Yucaipa, Calif. 92399

[21] Appl. No.: 910,234

[22] Filed: Sep. 19, 1986

[51] Int. Cl.[4] ..... H01R 13/639

[52] U.S. Cl. ..... 439/372; 439/35; 439/373

[58] Field of Search ..... 339/39, 75 R, 75 M, 339/75 P; 439/370, 372, 373, 35

[56] References Cited

U.S. PATENT DOCUMENTS

| | | | |
|---|---|---|---|
| 2,496,208 | 1/1950 | Hasselbaum | 339/39 |
| 2,515,257 | 7/1950 | O'Brien | 339/75 P |
| 3,059,073 | 10/1962 | French, Jr. | 339/75 P |
| 3,915,476 | 10/1975 | Burkle | 339/75 P |
| 4,061,407 | 12/1977 | Snow | 339/75 P |
| 4,072,381 | 2/1978 | Burkhart et al. | 339/39 |
| 4,245,875 | 1/1981 | Shaffer et al. | 339/39 |
| 4,544,225 | 10/1985 | Raus et al. | 339/75 R |

*Primary Examiner*—John McQuade

*Attorney, Agent, or Firm*—Roger A. Marrs

[57] ABSTRACT

A latching device is disclosed herein for releasably securing the components of a plugable electrical connector together to prevent inadvertent decoupling therebetween. The device includes a semicircular base attached to a support about one component of plugable connector while pivotally mounting a latch arm at one end. The opposite end of the latch arm is provided with a closure opening for cooperating with a closure latch projecting from the underside of a lug carried on the base in fixed spaced apart relationship with respect to the latch arm pivot connection with the base. When latched, the arm bears against the other component of the plugable connector so that the other component is fixedly held in connection with the first mentioned component of the connector.

5 Claims, 1 Drawing Sheet

SECURITY LATCH FOR ELECTRICAL CONNECTORS

BACKGROUND OF THE INVENTION

1. Field of the Invention

The present invention relates to latching devices for electrical connectors and more particularly to a novel latching device for restraining the components of a plug-in connector in place after connection to prevent inadvertent separation between the component connector parts when the connector is subjected to vibrations or abnormal loading conditions.

2. Brief Description of the Prior Art

In the trucking industry, it is conventional practice to employ a tractor-trailer truck rig having electrical cabling from the trailer detachably connected to the tractor by means of a two-component plug-in type electrical connection. Although such a connector serves well under most road conditions, difficulties and problems have been experienced which stem largely from the fact that unwanted vibrations are inherent in over-the-road travel.

Attempts have been made to overcome inadvertent separation between the plug and receptacle of a two-component electrical connector wherein a latch device is employed for releasably holding the plug in connection with the receptacle. However, the latch is maintained in position by means of a removable pin which has proven to be lacking in safety since the pin can easily be lost or inadvertently separated from mated holes into which it has been inserted. Also, prior latching devices have incorporated elongated supports engagable with the underside of the plug portion of the connector so as to prevent the plug from pivoting downwards due to the effect of gravity which generally results in the plug slipping out of or wearing prematurely at its connection with the receptacle or socket into which the plug is inserted. Furthermore, the prior device incorporates an assembly of plastic pads or pad on the latching or restraining device for preventing unwanted wear on the electrical connector plug and such a pad is carried on the cantilevered support engagable with the underside of the plug portion of the connector.

Therefore, the prior device has not provided sufficient safety features to prevent the inadvertent disconnection of the plug from its receptacle or socket since the locking pin may be lost or inadvertently removed from mating holes. Also, the prior device requires cantilevered portions which project outwardly to support the bottom of the plug and further requires an assembly procedure whereby plastic pads are required to be added to the device during manufacture. The device then becomes expensive, cumbersome to install, unreliable in use and nonfunctional for its intended purpose.

In view of the foregoing, it can be seen that a long-standing need has existed to provide a latching device which will automatically secure itself when placed into a plug restraining position without the use of insertable pins or the like and which does not require additional components such as supporting means for the plug.

SUMMARY OF THE INVENTION

Accordingly, the above problems and difficulties are obviated by the present invention which provides a novel latching or restraining device for maintaining the plug in connection with a socket or receptacle of an electrical connector which includes a base attachable to the surrounding area of the receptacle or plug and having a pivotal arm carried on the base positionable over the top of the plug and having a latch means for releasably securing the opposite end of the latch arm to the base when the arm is in its restraining position against the plug. A feature resides in providing the arm from a resilient composition so that a downward tension is applied to the plug by providing the pivot connection and latch connection to the base at a level lower than the top of the plug. Such action urges the underside of the plug into forced and binding interference fit with the underside of the receptacle. A feature further resides in providing the latch mechanism with a projecting hook adapted to enter a slot or opening in the base to provide a releasable securement.

Therefore, it is among the primary objects of the present invention to provide a novel latching or restraining device for use in combination with an electrical connector comprising a plug and socket whereby the plug is restrained in connection with the socket so that inadvertent vibrations will not dislodge the components from each other.

Another object of the present invention is to provide a novel restraining device having a pivoting latching arm with self-latching mechanism operable to prevent unwanted electrical disconnection between a plug and its socket due to road or other vibrations.

Still a further object of the present invention is to provide a restraining device including a latching mechanism which is carried adjacent to a two-component electrical connector for the purpose of restraining the components in mated and connected position.

Yet another object of the present invention is to provide a restraining apparatus for electrical connectors which is easy to manufacture, readily installable to existing connector fixtures, and which may be operated in a simple and automatic fashion.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF THE PREFERRED EMBODIMENT

Figure 1:
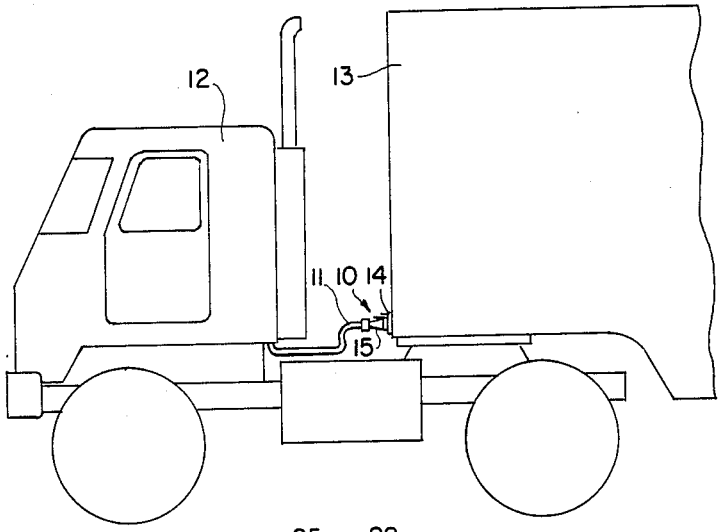
FIG. 1 is a side elevational view of a typical tractor-trailer combination having an electrical cable connected therebetween and which employs the novel restraining or latching device of the present invention.

Referring to FIG. 1, a standard electrical connector in the general direction of arrow 10 is illustrated joining an electrical cable 11 extended between a tractor 12 and a trailer 13 of an over-the-road truck rig. The electrical connector is of a two-component type wherein the end of cable 11 terminates in a plug which is insertably received into a mating receptacle or socket fixedly carried on a trailer 13 associated with the tractor 12. The purpose of the plug is to effect an electrical connection between electrical conducting wires within the cable 11 to appropriate conductors in the socket carried on the tractor. Standard hardware for electrical connectors of this type between tractors and trailers is designed with a cover plate which pivots downward to cover the socket opening when it is not in use. The conventional cover plate typically is pivoted upwardly when the plug is inserted and the underside of the cover conventionally carries a tab which engages behind a restraining boss on the plug for the purpose of preventing the plug from being disconnected due to vibrations or the like as the rig traverses the roadway. The socket is represented by numeral 14 while the plug is indicated by numeral 15.

In practice, a number of factors combine to make the standard electrical connector and methods of retaining the electrical plug in place ineffective. First, the effect of gravity on the plug 15 and the cable 11 tend to cause the plug to pivot downwards and to disengage the cover tab from the restraining boss. At this time, the plug will disengage with the socket causing disruption of electrical power to the trailer 13. Since a typical truck rig will experience over one million miles during its useful life, the accompanying vibrations will cause inevitable wear and damage to the connector component parts and eventually cause disengagement. Still further, plug and socket electrical connecting parts are made by a variety of manufacturers from a variety of materials which results in further compatibility and tolerance problems.

The net effect of the above-referenced problems is that plugs frequently pivot downward and pull out of the sockets causing unwanted disconnection of trailer lights and damage to plugs when they dangle down and drag on the roadway. The electrical retention or latching device of the present invention is employed to prevent wear and to support and restrain the plug sufficiently to eliminate the above-mentioned connection problems encountered with conventional restraining and latching devices.

The present invention functions by the operation of two separate principles. The first principle is that of supporting a horizontal electrical connector plug in its socket so as to prevent the plug from pivoting downwards due to the effect of gravity and slipping out of and/or wearing prematurely the electrical connector socket into which the plug is inserted. The second principle by which the present invention functions is the restraining of the electrical connector plug within the electrical connector socket to prevent unwanted electrical disconnection and to maintain the position of the electrical plug fixed to the socket construction.

Figure 2:
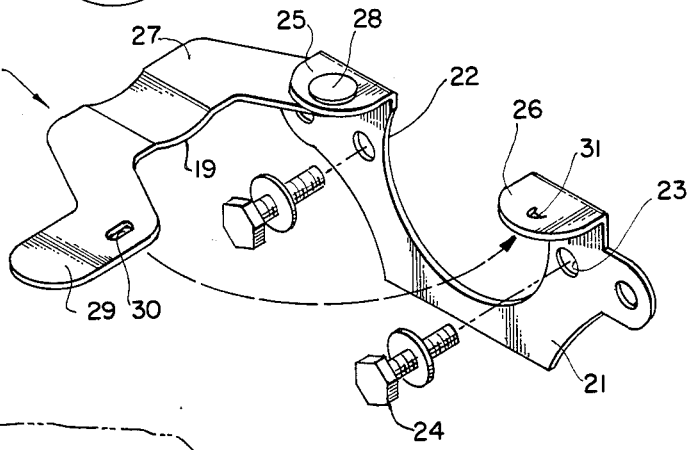
FIG. 2 is an enlarged perspective view showing the novel restraining or latching device of the present invention as used in the combination shown in FIG. 1.

Referring now in detail to FIG. 2, a novel restraining or latching device is indicated in the general direction of arrow 10 which is used to overcome the aforementioned problems in restraining an electrical connector plug. The device includes a semicircular base 21 having an opening indicated by number 22 permitting the base 21 to be fitted around the periphery of socket 14. Mounting holes, such as hole 23, are provided on each side of the opening 25 for insertably receiving mounting screws or fasteners such as fastener 24. Additional holes are provided laterally of the holes 23 that are available for use when alignment with other openings in the socket fixture are available. The base 21 is provided with mounting tabs 25 and 26 at the respective ends of the base defining an entrance leading into the opening 22. Therefore, the mounting tabs 25 and 26 are in fixed spaced relationship on opposite sides of the opening. Mounting tab 25 is employed for pivotally mounting an arm 27 taking the form of a yoke having one leg movably attached to the mounting tab 25 by a pivot connector 28. The opposite end of arm 27 includes one-half of a closure means taking the form of a slotted opening 30. Outwardly projecting into a free end is a finger tab 29 readily grasped between the fingers of the user for pivoting the arm 27. The other half of the closure means takes the form of a downwardly projecting hook 31 which is punched out of the same material as the mounting tab 26. The arm 27 is intentionally mounted on the underside of the mounting tab 25 so that when the arm is rotated towards the mounting tab 26, the leading edge of the finger tab 29 will bear against the hook 31 beneath the mounting tab 26. When the arm 27 has been pushed on up towards the hook 31, the hook will drop into the opening 30 for releasable securement. In order to release the closure, the finger portion 29 is downwardly depressed to remove the hook 31 from opening 30.

The present invention functions by the operation of the aforementioned two separate principles wherein the first is that of supporting a horizontal electrical connector plug to prevent it from pivoting downwards and slipping out of the socket into which it is inserted. The second principle mentioned is the restraining of the electrical connector plug with the electrical connector socket so as to prevent unwanted electrical disconnection and to secure the plug in the socket until released.

Figure 3:
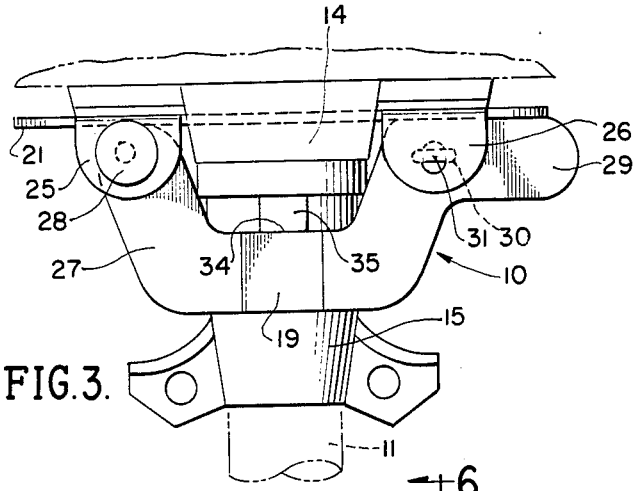
FIG. 3 is a top plan view of the restraining or latching device illustrating the device in its latched position about the plug component of an electrical connector.
Figure 4:
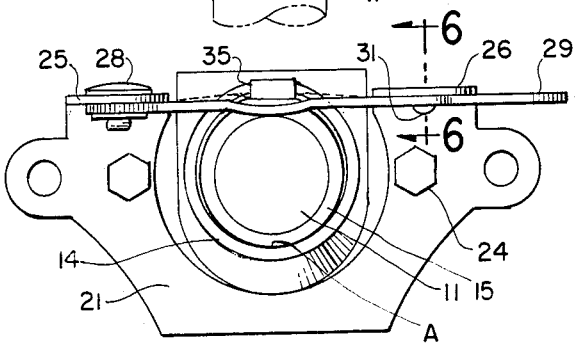
FIG. 4 is a front elevational view of the connector shown in FIG. 3 with the latching device in its latched position.

Referring in detail to FIG. 3, the principle of restraining the plug 15 in the socket 14 is accomplished by the inventive restraining device 10 wherein the base 21 is illustrated attached to the front face of the fixture supporting socket 14. The arm at 27 has been rotated about pivot 28 to the point where the opening 30 in the finger tab 29 of arm 27 has accepted the latch or hook 31. At this time, the center of the arm 27 along its inner edge marginal region 34 either bears against the restraining boss 35 carried on the upper surface of the plug 15 or stops in close proximity thereto. In either event, the plug 15 cannot retreat from its securement with the socket 14 since the presence of the arm 27 will prevent the boss 35 from backing out. With respect to the second principle, reference is made to FIG. 4 wherein it can be seen that when the arm 27 is in its closed or latched position, the arm flexes over its engaged contact with the upper surface of plug 15 and assumes the position shown in broken lines. The flexing of the arm 27 over the top surface of the socket 15 is assured by placing the mounting tabs 25 and 26 at a location on the base 21 which is slightly lower than the horizontal plane of the top of plug 15. Therefore, when both ends of arm 27 are beneath the horizontal plane of the top of the plug 15, the arm will flex against its mounting tabs 25 and 26 since the arm is on the underside of the respective tabs so that a downward pressure or force is exerted against the plug 15 causing it to bind or bear against the edge of the socket 14 at a pressure point or load imparting point identified by A. Engagement of the underside of plug 15 with the opening leading into socket 14 fixes the plug with respect to the socket so that no further pivoting of the plug can take place. It is to be particulary noted that the plug is adequately supported by this engagement with the socket and that no additional extension, support-builder, pad or the like is needed to cantilever out from the base and support the plug therebeneath.

Figure 6:
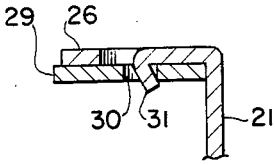
FIG. 6 is an enlarged transverse cross-sectional view of the latch employed in the restraining or latching device as taken in the direction of arrows 6—6 of FIG. 4.
Figure 5:
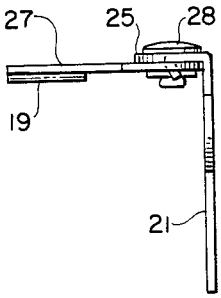
FIG. 5 is an enlarged side elevational view showing the pivot connection of the latch arm to the base as employed in the embodiments shown in FIGS. 2–4 inclusive.

Referring now to FIG. 5, it can be seen that the one end of arm 27 is pivotally connected to the mounting tab 25 by means of the pivot connector 28. Also, in FIG. 6, it is to be noted that the hook 31 is bent over itself so that as the finger portion 29 of arm 27 is pushed toward the hook, the leading edge of the finger portion will bear against the sloping or slanted side of hook 31 which causes the arm 27 to depress slightly until the hook drops into the opening 30. Therefore, it is important to note that the material of the arm 27 is sufficiently pliable or flexible to permit not only downward deflection as the end 29 rides over the hook 31, but will flex to the position shown in broken lines in FIG. 4 to exert the downward pressure against the socket so that a binding relationship occurs at point A. Preferably, the arm 27 is composed of a spring steel which offers the flexibility and biasing necessary to achieve the binding or supporting relationship for the plug.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. An electrical connector securing device for preventing unwanted disconnection of a socket from a plug in a socket and plug electrical combination comprising:

an electrical plug;

an electrical socket for insertably receiving said plug;

a support yoke secured about said socket and having a pair of arms separated by said socket, each arm terminating in a yoke arm flange projecting outwardly normal to said yoke;

a lever arm having opposite ends and pivotally secured at one end to a selected one of said yoke arm flanges and a latch means carried on one of the said lever ends detachably engageable with the other one of said yoke arm flanges; and said lever arm having an arcuate midsection engageable with said plug when said latch means is engaged for forcibly urging said plug into said socket and for supporting said plug on said socket.

2. The invention as defined in claim 1 wherein:

said plug includes a raised boss on its exterior surface engageable with said lever arm midsection and cooperating with said latch means to effect closure between said lever arm and said yoke.

3. The invention as define in claim 2 wherein:

said yoke lies in a vertical plane and said lever arm pivoting about a vertical axis between an open position out of latch engagement with the other one of said yoke arm flanges and a closed position in latching engagement with the other one of said yoke arm flanges.

4. The invention as defined in claim 3 wherein:

said lever arm oppostie ends when engaged with said yoke arm flanges respectively bias said lever arm midsection into engagment with said plug.

5. The invention as defined in claim 4 wherein:

said lever arm opposite ends reside under said yoke arm flanges whereby said midsection urges said opposite ends agianst said yoke arm flanges when said lever arm is in its closed position.

* * * * *